US008405685B2

(12) United States Patent
Chang et al.

(10) Patent No.: US 8,405,685 B2
(45) Date of Patent: Mar. 26, 2013

(54) FLAT PANEL DISPLAY DEVICE

(75) Inventors: Yung-Yi Chang, Miao-Li County (TW); Shih-Hsin Wang, Miao-Li County (TW)

(73) Assignee: Chimei Innolux Corporation, Miaoli County (TW)

( * ) Notice: Subject to any disclaimer, the term of this patent is extended or adjusted under 35 U.S.C. 154(b) by 644 days.

(21) Appl. No.: 12/629,974

(22) Filed: Dec. 3, 2009

(65) Prior Publication Data

US 2010/0134472 A1 Jun. 3, 2010

(30) Foreign Application Priority Data

Dec. 3, 2008 (CN) ..... 2008 1 0305936

(51) Int. Cl.
*G09G 5/10* (2006.01)

(52) U.S. Cl. ..... 345/690; 345/89

(58) Field of Classification Search ..... None
See application file for complete search history.

(56) References Cited

U.S. PATENT DOCUMENTS

| | | | | |
|---|---|---|---|---|
| 6,373,479 | B1 | 4/2002 | Moon | |
| 7,129,921 | B2 * | 10/2006 | Yeon et al. | 345/89 |
| 7,298,352 | B2 | 11/2007 | Kang et al. | |
| 7,542,022 | B2 | 6/2009 | Park | |
| 2006/0164355 | A1 * | 7/2006 | Kim et al. | 345/89 |
| 2007/0211006 | A1 * | 9/2007 | Lee et al. | 345/89 |
| 2008/0198118 | A1 * | 8/2008 | Choi | 345/89 |

* cited by examiner

*Primary Examiner* — Adam R Giesy
(74) *Attorney, Agent, or Firm* — WPAT PC; Justin King

(57) ABSTRACT

A flat panel display device includes an image processing circuit, a power supply, and a gamma voltage generator. The image processing circuit receives grayscale data, identifies a range in which a gray level of the grayscale data is located, and generates a reference signal based on the range. The power supply supplies a drive voltage based on the reference signal. The gamma voltage generator generates a set of gamma voltages based on the drive voltage.

16 Claims, 7 Drawing Sheets

| DX5 | DX4 | S3 | S2 | S1 | S0 | Vi |
|---|---|---|---|---|---|---|
| 0 | 0 | 0 | 0 | 0 | 1 | V1 |
| 0 | 1 | 0 | 0 | 1 | 0 | V2 |
| 1 | 0 | 0 | 1 | 0 | 0 | V3 |
| 1 | 1 | 1 | 0 | 0 | 0 | V4 |

FIG. 5

FLAT PANEL DISPLAY DEVICE

BACKGROUND

1. Technical Field

Embodiments of the present disclosure relate to display devices, and particularly to a flat panel display device.

2. Description of Related Art

Flat panel display devices are increasingly popular in use as computer monitors and televisions. Most current flat panel display devices utilize liquid crystal display (LCD) or plasma display panel technology. Referring to FIG. 7, an LCD device 100 often includes a power supply 105, a gamma voltage generator 106, a timing controller 101, a scan driver 102, a data driver 103, and an LCD panel 104. The power supply 105 supplies a drive voltage to the gamma voltage generator 106. The gamma voltage generator 106 supplies gamma voltages to the data driver 103. Each gamma voltage corresponds to a gray level in consideration of an electro-optical characteristic of the LCD panel 104. The timing controller 101 supplies the scan driver 102 and the data driver 103 with a gate start pulse and a clock signal correspondingly. The scan driver 102 sequentially drives gate lines of the LCD panel 104 based on the gate start pulse. The data driver 103 receives grayscale data (contains R, G and B data), latches the grayscale data in synchronization with the clock signal, and corrects the latched grayscale data in accordance with the gamma voltages. Then, the data driver 103 converts the corrected grayscale data into analog data and supplies it to data lines of the LCD panel 104.

However, most current gamma voltage generators cannot apply appropriate gamma voltages suitable for each signal containing the grayscale data from various peripheral devices because the gamma voltages are predetermined. As a result, the LCD panel presents color distortion of a displayed image originating with a peripheral device, deteriorating quality of the display image.

Therefore, a flat panel display device is needed that addresses the limitations described.

BRIEF DESCRIPTION OF THE DRAWINGS

Many aspects of the embodiments can be better understood with references to the following drawings. The components in the drawings are not necessarily drawn to scale, the emphasis instead being placed upon clearly illustrating the principles of the embodiments. Moreover, in the drawings, like reference numerals designate corresponding parts throughout the several views.

FIG. 5 is a graphical table showing one embodiment relationships between outputs of the power supply and grayscale data.

DETAILED DESCRIPTION

Figure 1:
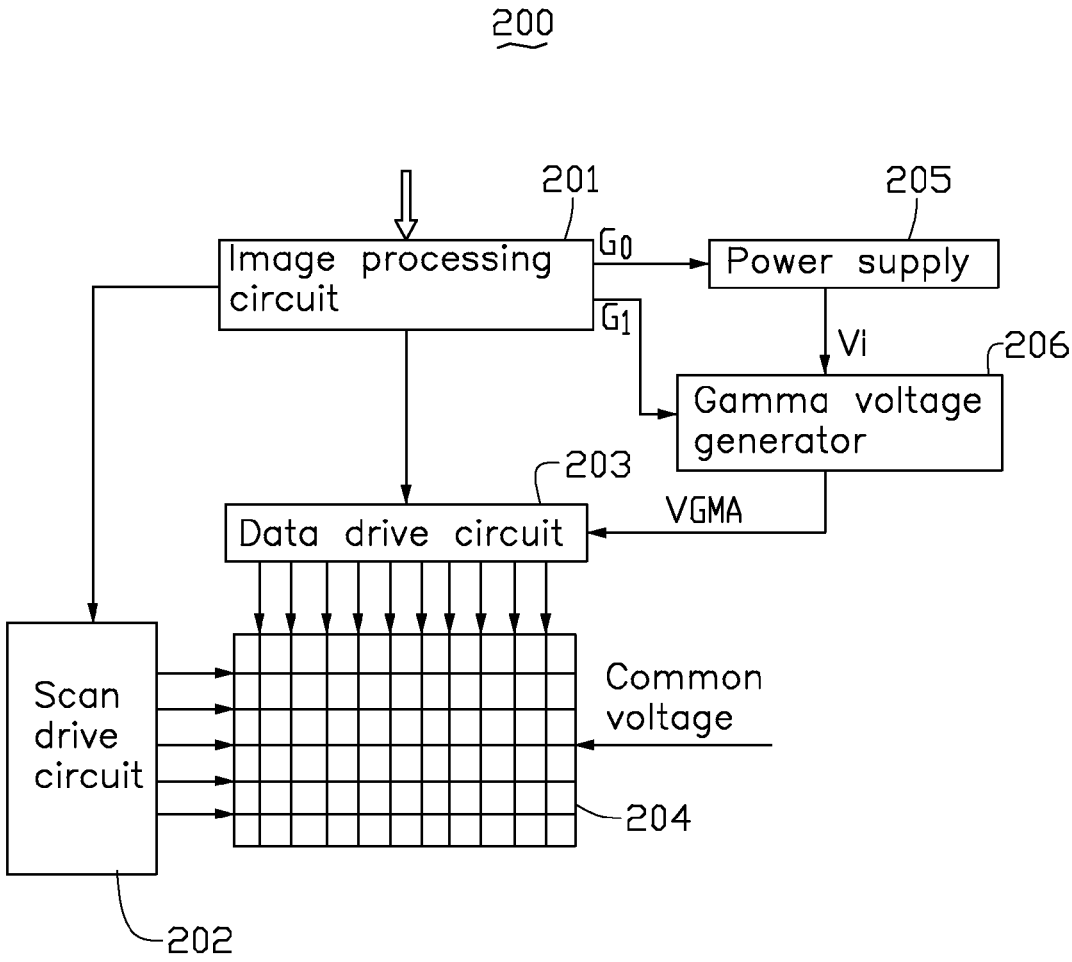
FIG. 1 is a block diagram of a flat panel display device including an image processing circuit, a power supply, a gamma voltage generator, a data drive circuit, and a display panel in accordance with one embodiment of the present disclosure.

Referring to FIG. 1, a flat panel display device 200 in accordance with one embodiment is shown. The flat panel display device 200 includes an image processing circuit 201, a scan drive circuit 202, a data drive circuit 203, a display panel 204, a power supply 205, and a gamma voltage generator 206. The display panel 204 includes a plurality of pixels defined by gate lines and data lines. The power supply 205 is operable to supply a varying drive voltage Vi to the gamma voltage generator 206 according to input grayscale data. The gamma voltage generator 206 is operable to supply corresponding gamma voltages VGMA to the data drive circuit 203 based on the varying drive voltage Vi, whereby the data drive circuit 203 can correct the input grayscale data accordingly and the display panel 204 can display the image represented by the grayscale data correctly. In the embodiment, the display panel 204 may be a thin-film transistor (TFT) LCD.

Figure 2:
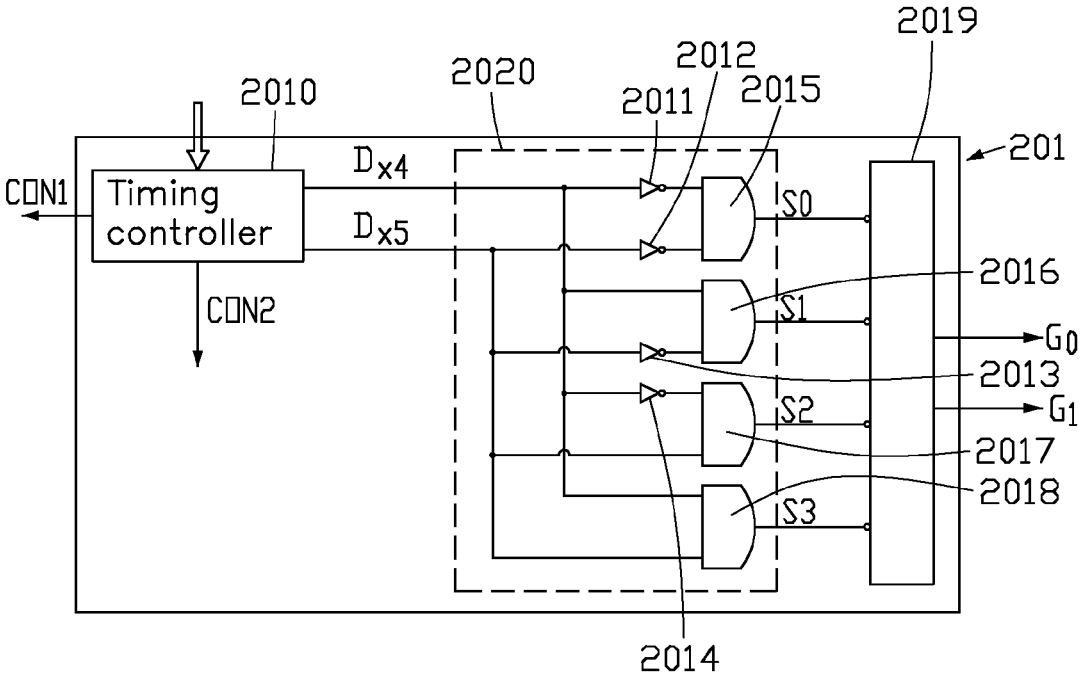
FIG. 2 is a circuit diagram of one embodiment the image processing circuit of FIG. 1.

In the embodiment, referring also to FIG. 2, the image processing circuit 201 includes a timing controller 2010, an encoder 2020, and a processor 2019. The timing controller 2010 receives the input grayscale data (hereinafter, grayscale data) from a peripheral device, such as a personal computer, a camera, a television, or a media player. The timing controller 2010 further generates a gate start signal CON1 and a clock signal CON2, and supplies the scan drive circuit 202 with the gate start signal CON1, and the data drive circuit 203 with the clock signal CON2 and the grayscale data via a reduced swing differential signaling (RSDS) interface.

Figure 6:
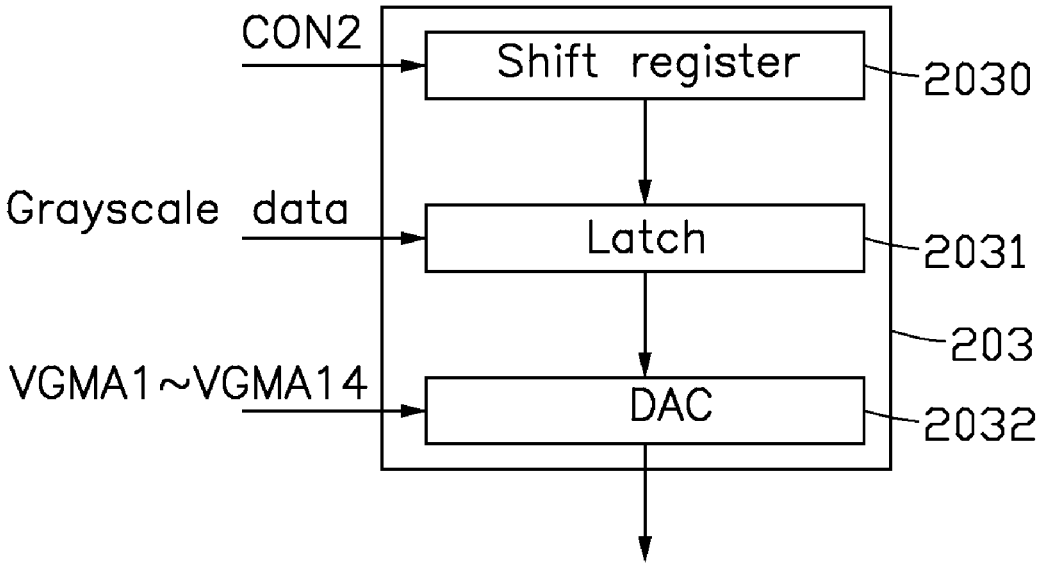
FIG. 6 is a block diagram of one embodiment the data drive circuit of FIG. 1.
Figure 7:
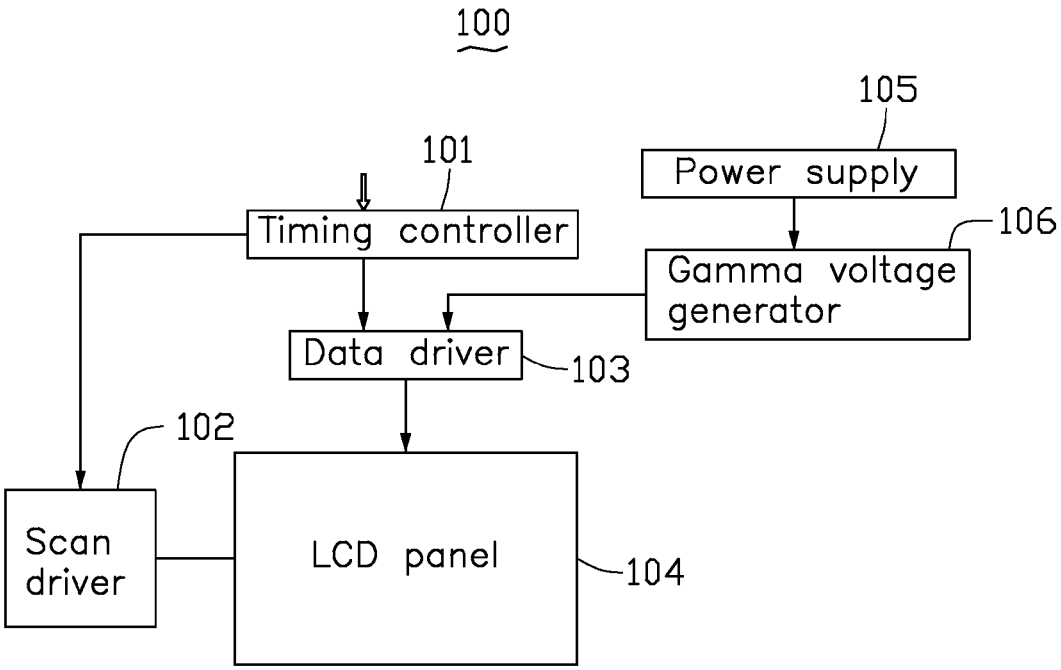
FIG. 7 (RELATED ART)
FIG. 7 is block diagram of a commonly used flat panel display device.

In response to receiving the gate start signal CON1, the scan drive circuit 202 generates a scan signal to sequentially drive the gate lines of the LCD panel 204. In response to receiving the clock signal CON2, the data drive circuit 203 receives the grayscale data via a latch 2031 (see FIG. 6), uses the latch 2031 to latch the grayscale data in synchronization with the clock signal CON2 (received and processed by a shift register 2030), and uses a multi-channel DAC (digital to analog convertor) 2032 to correct the latched grayscale data in accordance with the gamma voltages from the gamma voltage generator 206. Then, the data drive circuit 203 converts the corrected grayscale data to analog voltages (hereinafter referred to grayscale voltages) and supplies the grayscale voltages to the data lines of the LCD panel 204.

The timing controller 2010 further transmits at least the first two bits of the grayscale data to the encoder 2020 to identify a range in which a gray level of the grayscale data is located. In the embodiment, the timing controller 2010 transmits first two bits of the grayscale data to the encoder 2020 via a first data output terminal Dx5 and a second data output terminal Dx4. The encoder 2020 encodes the first two bits of the grayscale data into four-bit data representing the range.

The encoder 2020 includes a first NOT gate 2011, a second NOT gate 2012, a third NOT gate 2013, a fourth NOT gate 2014, a first AND gate 2015, a second AND gate 2016, a third AND gate 2017, and a fourth AND gate 2018. The second data output terminal Dx4 is connected to the first and the third AND gates 2015, 2017 via the first and the fourth NOT gates 2011, 2014 correspondingly. The second data output terminal Dx4 is also connected to the second and the fourth AND gates 2016, 2018. The first data output terminal Dx5 is connected to the first and the second AND gates 2015, 2016 via the second and the third NOT gates 2012, 2013 correspondingly. The first data output terminal Dx5 is also connected to the third and the fourth AND gates 2017, 2018. The output terminals S0, S1, S2, S3 of the first to fourth AND gates 2015, 2016, 2017, 2018 are connected to the processor 2019.

The processor 2019 generates a reference signal G0 and a switching signal G1 according to the four-bit data. The reference signal G0 is transmitted to the power supply 205 to direct the power supply 205 to supply the gamma voltage generator 206 with a corresponding drive voltage Vi, i∈(1, 2, 3, 4). The switching signal G1 is transmitted to the gamma voltage generator 206.

Figure 3:
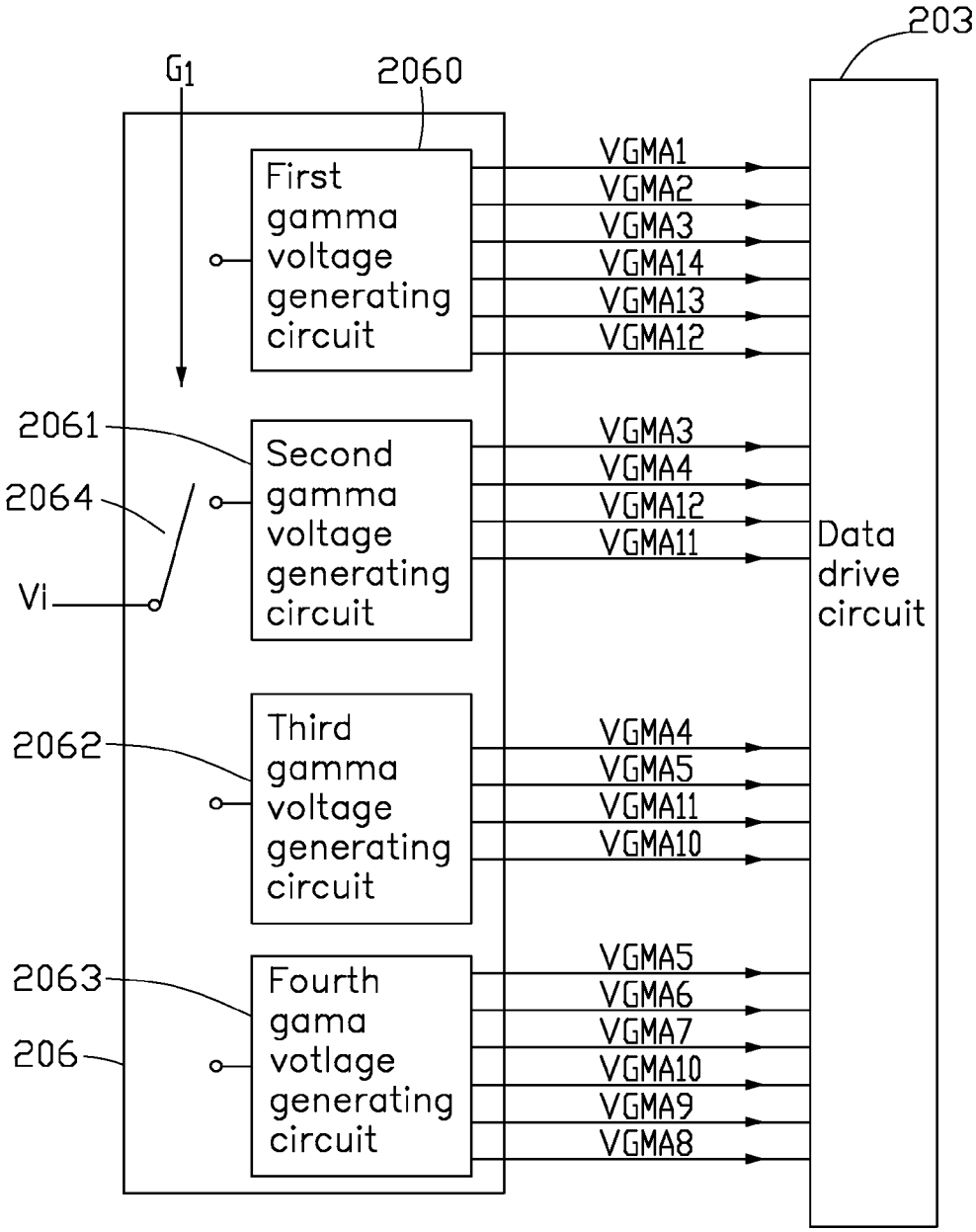
FIG. 3 is a circuit diagram of one embodiment of the gamma voltage generator and the data drive circuit of FIG. 1.

The gamma voltage generator 2060 is configured for generating corresponding gamma voltages according to the drive voltage Vi. Referring to FIG. 3, the gamma voltage generator 206 includes a first gamma voltage generating circuit 2060, a second gamma voltage generating circuit 2061, a third gamma voltage generating circuit 2062, a fourth gamma voltage generating circuit 2063, and a switching unit 2064. The switching unit 2064 is configured to receive the drive voltage Vi from the power supply 205 and selectively transmit the drive voltage Vi to one of the first to fourth gamma voltage generating circuits 2060, 2061, 2062, or 2063 according to the switching signal G1.

Referring to FIG. 5, relationships between the drive voltages Vi from the power supply 205 and the first two bits of the grayscale data are shown. The output terminals S3, S2, S1, S0 together output data "0001" when the timing controller 2010 outputs data "00". Accordingly, the processor 2019 outputs the reference signal G0 to signal the power supply 205 to supply a drive voltage V1 to the gamma voltage generator 206, and outputs the switching signal G1 to signal the switching unit 2064 to transmit the drive voltage V1 to the first gamma voltage generating circuit 2060. The output terminals S3, S2, S1, S0 together output data "0010" when receiving data "01". Accordingly, the processor 2019 outputs the reference signal G0 to signal the power supply 205 to supply a drive voltage V2 to the gamma voltage generator 206, and outputs the switching signal G1 to signal the switching unit 2064 to transmit the drive voltage V2 to the second gamma voltage generating circuit 2061. The output terminals S3, S2, S1, S0 together output data "0100" when receiving data "10". Accordingly, the processor 2019 outputs the reference signal G0 to signal the power supply 205 to supply a drive voltage V3 to the gamma voltage generator 206, and outputs the switching signal G1 to signal the switching unit 2064 to transmit the drive voltage V3 to the third gamma voltage generating circuit 2062. The output terminals S3, S2, S1, S0 together output data "1000" when receiving data "11". Accordingly, the processor 2019 outputs the reference signal G0 to signal the power supply 205 to supply a drive voltage V4 to the gamma voltage generator 206, and outputs the switching signal G1 to signal the switching unit 2064 to transmit the drive voltage V4 to the fourth gamma voltage generating circuit 2063. That is, in the embodiment, the gray levels of the grayscale data are divided into four ranges based on the first two bits of the grayscale data. It should be noted that the drive voltages V1, V2, V3, V4 are decreasing.

Referring back to FIG. 3, the first to fourth gamma voltage generating circuits 2060, 2061, 2062, 2063 are each operable to generate a set of gamma voltages VGMAn, and 14 gamma voltages in all, where n is an integer. The 14 gamma voltages VGMAn can be divided into a first group, including gamma voltages VGMA1-VGMA7, and a second group including gamma voltages VGMA8-VGMA14. The 14 gamma voltages VGMAn satisfy the following logical relation: VGMA1>VGMA2>VGMA3>VGMA4>VGMA5>VGMA6>VGMA7>$V_{COM}$>VGMA8>VGMA9>VGMA10>VGMA11>VGMA12>VGMA13>VGMA14. $V_{COM}$ is a common voltage applied to a common electrode (not shown) of the display panel 204.

The first gamma voltage generating circuit 2060 is operable to supply 6 gamma voltages VGMA1, VGMA2, VGMA3, VGMA12, VGMA13, VGMA14 to the data drive circuit 203 when receiving the drive voltage V1. The second gamma voltage generating circuit 2061 is operable to supply 4 gamma voltages VGMA3, VGMA4, VGMA11, VGMA12 to the data drive circuit 203 when receiving the drive voltage V2. The third gamma voltage generating circuit 2062 is operable to supply 4 gamma voltages VGMA4, VGMA5, VGMA10, VGMA11 to the data drive circuit 203 when receiving the drive voltage V3. The fourth gamma voltage generating circuit 2063 is operable to supply 6 gamma voltages VGMA5, VGMA6, VGMA7, VGMA8, VGMA9, VGMA10 to the data drive circuit 203 when receiving the drive voltage V4.

Figure 4:
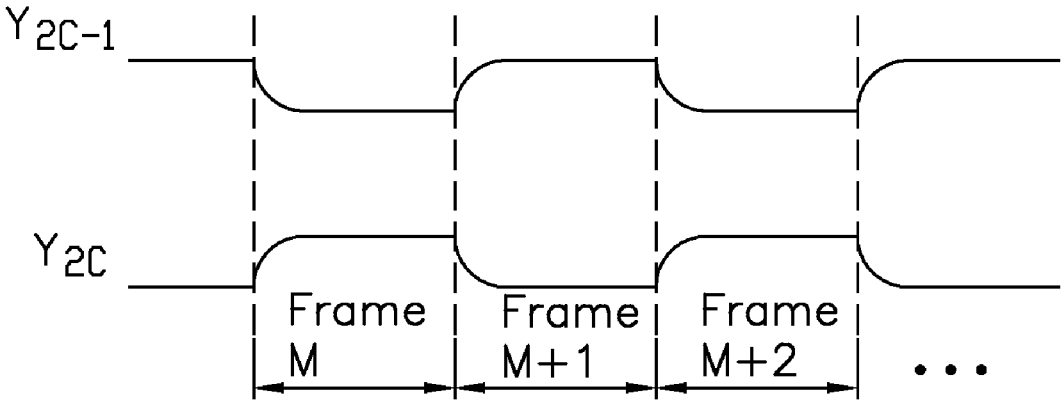
FIG. 4 is a waveform diagram of exemplary gamma voltages applied to data lines of the display panel of FIG. 1.

Referring to FIG. 4, in the dot inversion driving mode, when displaying a frame M (M is an integer), to drive an odd data line $Y_{2C-1}$ (C is an integer), a first grayscale voltage is generated according to the gamma voltages VGMA8~VGMA14. To drive an even data line $Y_{2C}$ next to the odd data line $Y_{2C-1}$, a second grayscale voltage is generated according to the gamma voltages VGMA1~VGMA7.

When displaying a frame M+1 immediately following the frame M, to drive the odd data line $Y_{2C-1}$, a third grayscale voltage is generated according to the gamma voltages VGMA1~VGMA7. To drive the even data line $Y_{2C}$, a fourth grayscale voltage is generated according to the gamma voltages VGMA8~VGMA14. To display a frame M+2 immediately following the frame M+1, the drive method is similar to that for the frame M. The display of the rest frames may be deduced by analogy.

Assuming the grayscale data for a pixel is represented by 6-bit grayscale data (labeled by D5~D0), the data drive circuit 203 can generate 64 grayscale voltages to drive a data line. The following tables 1-1~1-4 show relationships between the 6-bit grayscale data, gray levels of the 6-bit grayscale data and the grayscale voltages generated according to the gamma voltages VGMA1~VGMA7. When the grayscale voltages are to be generated according to the gamma voltages VGMA8~VGMA14, the gamma voltages VGMA1~VGMA7 are simply replaced with the gamma voltages VGMA14~VGMA8 accordingly.

TABLE 1-1

| D5 | D4 | D3 | D2 | D1 | D0 | Gray level | Grayscale voltage |
|---|---|---|---|---|---|---|---|
| 0 | 0 | 0 | 0 | 0 | 0 | VH0 | VGMA1 |
| 0 | 0 | 0 | 0 | 0 | 1 | VH1 | VGMA2 |
| 0 | 0 | 0 | 0 | 1 | 0 | VH2 | VGMA2 + (VGMA3 – VGMA2) * 1307/6850 |
| 0 | 0 | 0 | 0 | 1 | 1 | VH3 | VGMA2 + (VGMA3 – VGMA2) * 2265/6850 |
| 0 | 0 | 0 | 1 | 0 | 0 | VH4 | VGMA2 + (VGMA3 – VGMA2) * 2996/6850 |
| 0 | 0 | 0 | 1 | 0 | 1 | VH5 | VGMA2 + (VGMA3 – VGMA2) * 3602/6850 |
| 0 | 0 | 0 | 1 | 1 | 0 | VH6 | VGMA2 + (VGMA3 – VGMA2) * 4109/6850 |
| 0 | 0 | 0 | 1 | 1 | 1 | VH7 | VGMA2 + (VGMA3 – VGMA2) * 4540/6850 |

TABLE 1-1-continued

| D5 | D4 | D3 | D2 | D1 | D0 | Gray level | Grayscale voltage |
|---|---|---|---|---|---|---|---|
| 0 | 0 | 1 | 0 | 0 | 0 | VH8 | VGMA2 + (VGMA3 – VGMA2) * 4913/6850 |
| 0 | 0 | 1 | 0 | 0 | 1 | VH9 | VGMA2 + (VGMA3 – VGMA2) * 5241/6850 |
| 0 | 0 | 1 | 0 | 1 | 0 | VH10 | VGMA2 + (VGMA3 – VGMA2) * 5533/6850 |
| 0 | 0 | 1 | 0 | 1 | 1 | VH11 | VGMA2 + (VGMA3 – VGMA2) * 5796/6850 |
| 0 | 0 | 1 | 1 | 0 | 0 | VH12 | VGMA2 + (VGMA3 – VGMA2) * 6039/6850 |
| 0 | 0 | 1 | 1 | 0 | 1 | VH13 | VGMA2 + (VGMA3 – VGMA2) * 6265/6850 |
| 0 | 0 | 1 | 1 | 1 | 0 | VH14 | VGMA2 + (VGMA3 – VGMA2) * 6474/6850 |
| 0 | 0 | 1 | 1 | 1 | 1 | VH15 | VGMA2 + (VGMA3 – VGMA2) * 6669/6850 |

TABLE 1-2

| D5 | D4 | D3 | D2 | D1 | D0 | Gray level | Grayscale voltage |
|---|---|---|---|---|---|---|---|
| 0 | 1 | 0 | 0 | 0 | 0 | VH16 | VGMA3 |
| 0 | 1 | 0 | 0 | 0 | 1 | VH17 | VGMA3 + (VGMA4 – VGMA3) * 169/1935 |
| 0 | 1 | 0 | 0 | 1 | 0 | VH18 | VGMA3 + (VGMA4 – VGMA3) * 325/1935 |
| 0 | 1 | 0 | 0 | 1 | 1 | VH19 | VGMA3 + (VGMA4 – VGMA3) * 474/1935 |
| 0 | 1 | 0 | 1 | 0 | 0 | VH20 | VGMA3 + (VGMA4 – VGMA3) * 614/1935 |
| 0 | 1 | 0 | 1 | 0 | 1 | VH21 | VGMA3 + (VGMA4 – VGMA3) * 747/1935 |
| 0 | 1 | 0 | 1 | 1 | 0 | VH22 | VGMA3 + (VGMA4 – VGMA3) * 873/1935 |
| 0 | 1 | 0 | 1 | 1 | 1 | VH23 | VGMA3 + (VGMA4 – VGMA3) * 995/1935 |
| 0 | 1 | 1 | 0 | 0 | 0 | VH24 | VGMA3 + (VGMA4 – VGMA3) * 1114/1935 |
| 0 | 1 | 1 | 0 | 0 | 1 | VH25 | VGMA3 + (VGMA4 – VGMA3) * 1229/1935 |
| 0 | 1 | 1 | 0 | 1 | 0 | VH26 | VGMA3 + (VGMA4 – VGMA3) * 1341/1935 |
| 0 | 1 | 1 | 0 | 1 | 1 | VH27 | VGMA3 + (VGMA4 – VGMA3) * 1449/1935 |
| 0 | 1 | 1 | 1 | 0 | 0 | VH28 | VGMA3 + (VGMA4 – VGMA3) * 1553/1935 |
| 0 | 1 | 1 | 1 | 0 | 1 | VH29 | VGMA3 + (VGMA4 – VGMA3) * 1654/1935 |
| 0 | 1 | 1 | 1 | 1 | 0 | VH30 | VGMA3 + (VGMA4 – VGMA3) * 1751/1935 |
| 0 | 1 | 1 | 1 | 1 | 1 | VH31 | VGMA3 + (VGMA4 – VGMA3) * 1845/1935 |

TABLE 1-3

| D5 | D4 | D3 | D2 | D1 | D0 | Gray level | Grayscale voltage |
|---|---|---|---|---|---|---|---|
| 1 | 0 | 0 | 0 | 0 | 0 | VH32 | VGMA4 |
| 1 | 0 | 0 | 0 | 0 | 1 | VH33 | VGMA4 + (VGMA5 – VGMA4) * 88/1321 |
| 1 | 0 | 0 | 0 | 1 | 0 | VH34 | VGMA4 + (VGMA5 – VGMA4) * 174/1321 |
| 1 | 0 | 0 | 0 | 1 | 1 | VH35 | VGMA4 + (VGMA5 – VGMA4) * 258/1321 |
| 1 | 0 | 0 | 1 | 0 | 0 | VH36 | VGMA4 + (VGMA5 – VGMA4) * 341/1321 |
| 1 | 0 | 0 | 1 | 0 | 1 | VH37 | VGMA4 + (VGMA5 – VGMA4) * 422/1321 |
| 1 | 0 | 0 | 1 | 1 | 0 | VH38 | VGMA4 + (VGMA5 – VGMA4) * 503/1321 |
| 1 | 0 | 0 | 1 | 1 | 1 | VH39 | VGMA4 + (VGMA5 – VGMA4) * 584/1321 |
| 1 | 0 | 1 | 0 | 0 | 0 | VH40 | VGMA4 + (VGMA5 – VGMA4) * 665/1321 |
| 1 | 0 | 1 | 0 | 0 | 1 | VH41 | VGMA4 + (VGMA5 – VGMA4) * 746/1321 |
| 1 | 0 | 1 | 0 | 1 | 0 | VH42 | VGMA4 + (VGMA5 – VGMA4) * 827/1321 |
| 1 | 0 | 1 | 0 | 1 | 1 | VH43 | VGMA4 + (VGMA5 – VGMA4) * 908/1321 |
| 1 | 0 | 1 | 1 | 0 | 0 | VH44 | VGMA4 + (VGMA5 – VGMA4) * 989/1321 |
| 1 | 0 | 1 | 1 | 0 | 1 | VH45 | VGMA4 + (VGMA5 – VGMA4) * 1070/1321 |
| 1 | 0 | 1 | 1 | 1 | 0 | VH46 | VGMA4 + (VGMA5 – VGMA4) * 1153/1321 |
| 1 | 0 | 1 | 1 | 1 | 1 | VH47 | VGMA4 + (VGMA5 – VGMA4) * 1237/1321 |

TABLE 1-4

| D5 | D4 | D3 | D2 | D1 | D0 | Gray level | Grayscale voltage |
|---|---|---|---|---|---|---|---|
| 1 | 1 | 0 | 0 | 0 | 0 | VH48 | VGMA5 |
| 1 | 1 | 0 | 0 | 0 | 1 | VH49 | VGMA5 + (VGMA6 – VGMA5) * 85/2201 |
| 1 | 1 | 0 | 0 | 1 | 0 | VH50 | VGMA5 + (VGMA6 – VGMA5) * 173/2201 |
| 1 | 1 | 0 | 0 | 1 | 1 | VH51 | VGMA5 + (VGMA6 – VGMA5) * 265/2201 |
| 1 | 1 | 0 | 1 | 0 | 0 | VH52 | VGMA5 + (VGMA6 – VGMA5) * 362/2201 |
| 1 | 1 | 0 | 1 | 0 | 1 | VH53 | VGMA5 + (VGMA6 – VGMA5) * 465/2201 |
| 1 | 1 | 0 | 1 | 1 | 0 | VH54 | VGMA5 + (VGMA6 – VGMA5) * 575/2201 |
| 1 | 1 | 0 | 1 | 1 | 1 | VH55 | VGMA5 + (VGMA6 – VGMA5) * 693/2201 |
| 1 | 1 | 1 | 0 | 0 | 0 | VH56 | VGMA5 + (VGMA6 – VGMA5) * 819/2201 |
| 1 | 1 | 1 | 0 | 0 | 1 | VH57 | VGMA5 + (VGMA6 – VGMA5) * 955/2201 |

TABLE 1-4-continued

| D5 | D4 | D3 | D2 | D1 | D0 | Gray level | Grayscale voltage |
|---|---|---|---|---|---|---|---|
| 1 | 1 | 1 | 0 | 1 | 0 | VH58 | VGMA5 + (VGMA6 – VGMA5) * 1107/2201 |
| 1 | 1 | 1 | 0 | 1 | 1 | VH59 | VGMA5 + (VGMA6 – VGMA5) * 1294/2201 |
| 1 | 1 | 1 | 1 | 0 | 0 | VH60 | VGMA5 + (VGMA6 – VGMA5) * 1528/2201 |
| 1 | 1 | 1 | 1 | 0 | 1 | VH61 | VGMA5 + (VGMA6 – VGMA5) * 1817/2201 |
| 1 | 1 | 1 | 1 | 1 | 0 | VH62 | VGMA6 |
| 1 | 1 | 1 | 1 | 1 | 1 | VH63 | VGMA7 |

To summarize, the flat panel display device 200 is operable to supply a varying drive voltage Vi to the gamma voltage generator 206 according to the input grayscale data. The gamma voltage generator 206 is operable to supply corresponding gamma voltages to the data drive circuit 203 based on the varying voltage, so that the data drive circuit 203 can correct the input grayscale data accordingly and the display panel 204 can display the image represented by the grayscale data accurately.

In other embodiments, the grayscale data may be an analog signal. In this condition, an image processing circuit of a plat panel display receives the grayscale data, and generates a reference signal according to various parts of the grayscale data. Each of the various parts belongs to a time sequence, and may have different image characteristic. A power supply similar to the power supply 205 supplies drive voltages to a gamma voltage generator similar to the gamma voltage generator 206.

It is to be understood, however, that even though numerous characteristics and advantages of the present disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. A flat panel display device, comprising:

an image processing circuit, for identifying a range for a gray level of a grayscale data, and generating a reference signal based on the range, comprising:

a timing controller to receive the scale data;

a first data output terminal and a second data output terminal for outputting first two bits of the grayscale data; and an encoder comprising four AND gates and four NOT gates, wherein the second data output terminal is connected to a first and a third AND gates via a first and a second NOT gates correspondingly, the second data output terminal is also connected to a second and a fourth AND gates, the first data output terminal is connected to the first and the second AND gates via a third and a fourth NOT gates correspondingly, and the first data output terminal is also connected to the third and the fourth AND gates; and a power supply operable to supply a drive voltage based on the reference signal; and a gamma voltage generator operable to generate a set of gamma voltages based on the drive voltage.

2. The flat panel display device of claim 1, wherein the range is identified by determining at least the first two bits of the grayscale data, where there are at least four ranges for all gray levels of the grayscale data.

3. The flat panel display device of claim 1, wherein the image processing circuit further comprises a processor connected to output terminals of the four AND gates, to generate the reference signal.

4. The flat panel display device of claim 1, wherein the image processing circuit further generates a switch signal and transmits the switch signal to the gamma voltage generator.

5. The flat panel display device of claim 4, wherein the gamma voltage generator comprises at least four gamma voltage generating circuits and a switching unit, each gamma voltage generating circuit configured for generating a set of gamma voltages, the switching unit selectively transmits the drive voltage to one of the at least four gamma voltage generating circuits according to the switch signal, and the one of the at least four gamma voltage generating circuits generates and then outputs the set of gamma voltages.

6. The flat panel display device of claim 5, further comprising a display panel comprising a plurality of pixels defined by gate lines and data lines, and a data drive circuit connected to the display panel and the gamma voltage generator; the data drive circuit generates grayscale voltages according to the grayscale data and the received set of gamma voltages, and sends the grayscale voltages to the data lines of the display panel.

7. The flat panel display device of claim 6, wherein the four sets of gamma voltages are divided into a first group and a second group, wherein gamma voltages in the first group exceed a common voltage applied to the display panel, and gamma voltages in the second group are lower than the common voltage.

8. The flat panel display device of claim 7, wherein when displaying a frame N, the data drive circuit generates the grayscale voltages to drive odd data lines according to the gamma voltages in the second group, and generates the grayscale voltages to drive even data lines according to the gamma voltages in the first group; when displaying a frame following the frame N, the data drive circuit generates the grayscale voltages to drive odd data lines according to the gamma voltages in the first group, and generates the grayscale voltages to drive even data lines according to the gamma voltages in the second group.

9. A flat panel display device, comprising:

an image processing circuit operable to receive grayscale data, and generate a first reference signal according to a first part of the grayscale data belonging to a first time sequence and a second reference signal according to a second part of the grayscale data belonging to a second time sequence, the second part of the grayscale data having different image characteristics from the first part of the grayscale data;

a power supply configured for supplying a first drive voltage and a second drive voltage based on the first reference signal and the second reference signal; and a gamma voltage generator configured for generating a first set of gamma voltages and a second set of gamma voltages according to the first drive voltage and the second drive voltage, and for generating a first group and a second group of gamma voltages corresponding to the first and second reference signals, gamma voltages in the first group exceed a common voltage applied to the display panel, gamma voltages in the second group is lower than the common voltage;

wherein when a gray level of the first part is lower than that of the second part, the first drive voltage exceeds the second drive voltage; and wherein when displaying a frame N, the data drive circuit generates the grayscale voltages to drive odd data lines according to the gamma voltages in the second group, and generates the grayscale voltages to drive even data lines according to the gamma voltages in the first group; when displaying a frame following the frame N, the data drive circuit generates the grayscale voltages to drive odd data lines according to the gamma voltages in the first group, and generates the grayscale voltages to drive even data lines according to the gamma voltages in the second group.

10. The flat panel display device of claim 9, wherein the first time sequence and the second time sequence comprise a frame or a line of the grayscale data.

11. The flat panel display device of claim 9, wherein the image processing circuit comprises a timing controller to receive the grayscale data and output the first two bits of the grayscale data via a first data output terminal and a second data output terminal of the image processing circuit.

12. The flat panel display device of claim 11, wherein the image processing circuit further comprises an encoder comprising four AND gates and four NOT gates; the second data output terminal is connected to a first and a third AND gates via two NOT gates correspondingly, the second data output terminal is also connected to a second and a fourth AND gates, the first data output terminal is connected to the first and the second AND gates via the two other NOT gates correspondingly, and the first data output terminal is also connected to the third and the fourth AND gates.

13. The flat panel display device of claim 12, wherein the image processing circuit further comprises a processor connected to output terminals of the four AND gates, to generate the first and second reference signals.

14. The flat panel display device of claim 9, wherein the image processing circuit further generates a switch signal and transmits the switch signal to the gamma voltage generator.

15. The flat panel display device of claim 14, wherein the gamma voltage generator comprises at least four gamma voltage generating circuits and a switching unit, each gamma voltage generating circuit configured for generating a set of gamma voltages, the switching unit selectively transmits the drive voltage to one of the at least four gamma voltage generating circuit according to the switch signal, and the one of the at least four gamma voltage generating circuit generates and then outputs the set of gamma voltages.

16. The flat panel display device of claim 15, further comprising a display panel comprising a plurality of pixels defined by gate lines and data lines, and a data drive circuit connected to the display panel and the gamma voltage generator; wherein the data drive circuit generates grayscale voltages according to the grayscale data and the received set of gamma voltages, and sends the grayscale voltages to the data lines of the display panel.

* * * * *